US006230802B1

(12) United States Patent
Duhon

(10) Patent No.: US 6,230,802 B1
(45) Date of Patent: May 15, 2001

(54) METHOD AND APPARATUS FOR GRAVEL PACKING A WELL

(75) Inventor: Mark Duhon, Houma, LA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/359,484

(22) Filed: Jul. 22, 1999

Related U.S. Application Data

(60) Provisional application No. 60/093,959, filed on Jul. 24, 1998.

(51) Int. Cl.[7] ..... E21B 43/04

(52) U.S. Cl. ..... 166/278; 166/51; 166/74; 166/177.2; 166/117.6; 166/177.7

(58) Field of Search ..... 166/51, 56, 69, 166/72, 74, 177.2, 177.6, 177.7, 276, 278

(56) References Cited

U.S. PATENT DOCUMENTS 4,280,557 * 7/1981 Bodine ..... 166/177
4,665,980 5/1987 Bodine .
5,033,549 7/1991 Champeaux et al. .
5,115,860 5/1992 Champeaux et al. .
5,273,114 * 12/1993 Wicks et al. ..... 166/278
5,361,830 * 11/1994 Wicks et al. ..... 166/51

FOREIGN PATENT DOCUMENTS

0245892A2 11/1987 (EP) .
2255996A 11/1992 (GB) .

OTHER PUBLICATIONS

British Patent Office Communication dated Aug. 20, 1999.

* cited by examiner

*Primary Examiner*—Roger Schoeppel
(74) *Attorney, Agent, or Firm*—Trop, Pruner & Hu P.C.

(57) ABSTRACT

An apparatus for use in gravel packing a well includes a tool body adapted to be lowered into the well, a screen coupled to the tool body, and a resilient member coupled to the screen. The apparatus is placed at a selected position in the well, and sand control media is disposed between the screen and the well while the resilient member is periodically excited to vibrate the screen.

38 Claims, 8 Drawing Sheets

METHOD AND APPARATUS FOR GRAVEL PACKING A WELL

This Appln claims the benefit of Provisional No. 60/093,959 filed Jul. 24, 1998.

BACKGROUND OF THE INVENTION

1. Technical Field

The invention relates generally to downhole tools and methods for completing a well and, more particularly, to a downhole tool and method for placing a gravel pack in a well.

2. Background Art

In the petroleum industry, completion of a well drilled through subterranean formations generally involves lining the well with a casing and using a perforating gun to create perforation tunnels through the casing and the formation adjacent the casing. The perforation tunnels are usually created adjacent the formation at pay zones to allow reservoir fluids to flow from the formation into the well. During production of the reservoir fluids, sand may flow from the formation into the well if the formation is composed of unconsolidated sand. Typically, production of sand along with reservoir fluids is undesirable for many reasons, some of which include clogging of surface equipment, erosion of the tubing strings and wellhead, and bridging of the well such that further production of reservoir fluids is prevented.

However, production of sand along with reservoir sands is not a new problem in the petroleum industry, and there has been a lot of research and development in the area of sand control during reservoir fluid production. One sand control technique that has been found to be successful and reliable is gravel pack completion. Gravel pack completion involves placing a screen in the well adjacent the perforation tunnels and filling an annular area between the casing and the screen, as well as the perforation tunnels, with well-sorted, coarse sand, called gravel pack. The gravel pack is highly porous and permeable and serves to filter formation sand from the reservoir fluids entering the well. The filtering performance of the gravel pack depends on the size and shape of the gravel pack sand and how well the gravel pack fills the annular area between the casing and the screen. If there are voids in the gravel pack, the formation sand can fill the voids and reduce the rate at which the reservoir fluids are produced, or the produced sand can erode the screen and cause the gravel pack to fail.

One method for efficiently placing gravel pack in the well and the perforation tunnels is circulating gravel packing. A gravel pack tool is lowered into the well on the end of a tubing string and gravel suspended in a carrier fluid is pumped down the bore of the tubing string and through a crossover tool into the annular area between the screen and the casing. The gravel is held in place by the screen while the carrier fluid flows through the screen and crossover tool into the casing annulus and back to the surface. Generally, the gravel pack tool is substantially larger than the tubing string and would typically require that any existing tubing string and other restrictions in the well be removed before the gravel pack tool is run into the well. However, retrieval of existing tubing in a well is a relatively expensive operation and may not be economically viable for marginally producing or nearly depleted wells.

Another method for placing gravel pack in the well and the perforation tunnel involves pumping a gravel slurry in a viscous carrier fluid through a tubing string. The carrier fluid is squeezed into the formation and placed across the perforated interval. Again, while the tubing string may be lowered through an existing tubing in the well, the cost of deploying the tubing string may be fairly expensive for marginally producing wells. Thus, it would be beneficial to have a tool that can efficiently place a gravel pack in a well and that can be lowered into the well through a tubing and other restrictions in the well. U.S. Pat. Nos. 5,033,549 and 5,115,860 to Champeaux et al. disclose a gravel pack tool that can be lowered through a tubing on the end of an electric wireline. The gravel pack tool features radially extending members that collapse while the gravel pack tool is lowered through the tubing and extends when the gravel pack is placed below the tubing. Gravel is disposed in the well annulus using a dump bailer.

SUMMARY OF THE INVENTION

One aspect of the invention is an apparatus for use in gravel packing a well which comprises a tool body adapted to be lowered into the well and a screen coupled to the tool body. A resilient member is coupled to the screen to vibrate the screen in response to an excitation force.

Another aspect of the invention is a method for gravel packing a well which comprises placing a screen at a selected position in the well, disposing sand control media in an annulus between the screen and the well, and periodically vibrating the screen to allow for even filling of the annulus.

Other aspects and advantages of the invention will be apparent from the following description and the appended claims.

DETAILED DESCRIPTION

Figure 1:
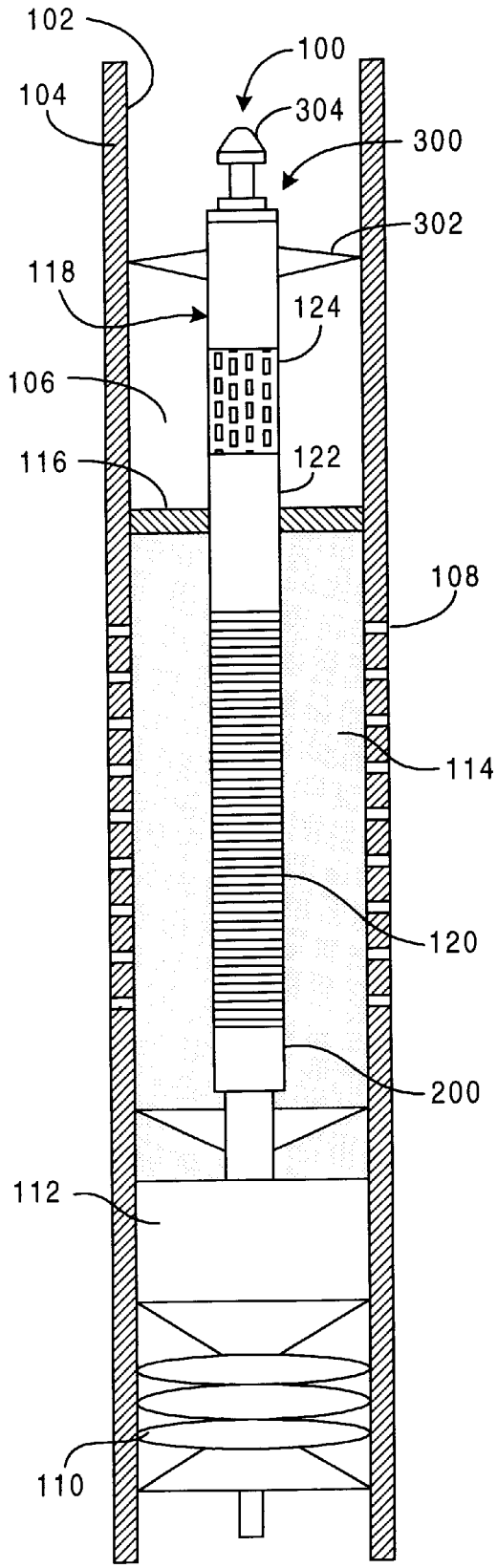
FIG. 1 is a schematic of a downhole tool suspended in a well.

Referring to the drawings wherein like characters are used for like parts throughout the several views, FIG. 1 shows a downhole tool 100 suspended in a well 102. A casing 104 extends along the length of the well 102. The downhole tool 100 is concentrically received in the well 102 such that an annular area 106 is defined between the casing 104 and the tool 100. The casing 104 includes perforations 108 which permit formation fluids from the formation adjacent the casing 104 to flow into the well 102. The portion of the annular area 106 adjacent the perforations 108 is isolated at the bottom by a plug 110 and cement section 112. The annular area above the cement section 112 is filled with a gravel pack 114. The gravel pack 114 may be composed of any uniform, graded, commercial silica sand. The gravel pack 114 may also be composed of appropriately sized spherical ceramic beads. A cement cap 116 above the gravel pack 114 prevents the gravel pack 114 from loosening.

The tool 100 includes a flow segment 118, a screen 120, and an oscillating assembly 200. The flow segment 118 includes a section of blank pipe 122, a vent pipe 124, and a latching head assembly 300. The latching head assembly 300 includes an upper centralizer 302 which centers the tool 100 within the well and helps locate the top of the tool. The latching head assembly 300 also includes a latching head 304 which allows for easy retrieval of the tool and for latching onto the tool to operate the oscillating assembly 200. The oscillating assembly 200 may be operated to oscillate the screen 120 to allow for efficient packing of gravel in the annular area between the casing and the screen. The lower end of the blank pipe 122 includes a threaded collar which mates with a similarly threaded collar on the upper end of the screen 120. The blank pipe 122 provides a reservoir for extra gravel above the screen 120.

Formation fluid flowing through the gravel pack 114 enters the screen 120 and flows upward into the vent pipe 124, where it exits into the annular area above the cement cap 116. The fluid in the annular area above the cement cap 116 may be returned to the surface through a tubing string (not shown). The screen 120 may be a wire-wrapped screen or other type of screen. There are many types of wire-wrapped screens, including ribbed, all-welded, groove, and wrapped-on-pipe. Typically, the all-welded screen is stronger and more corrosion-resistant and will not unravel if the wire is eroded or broken. The diameter of the screen 120 should be as large as possible and yet leave room for a gravel pack and be able to enter restricted diameter areas, such as tubing and valves, in the well. The screen size should be such that any formation sand entrained in the formation fluid does not get into the screen. The gravel size should be selected to restrict the movement of fine formation sand and, at the same time, allow production of formation fluids at economical rates.

Figure 2A:
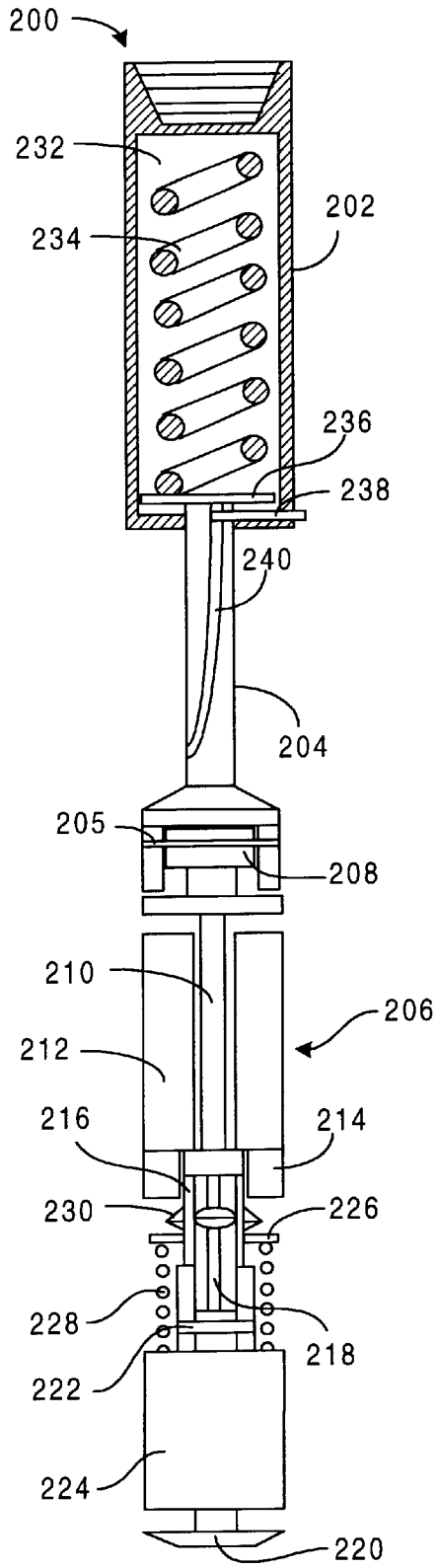
FIG. 2A is a cross-sectional view of the oscillating assembly referenced in FIG. 1.
Figure 2B:
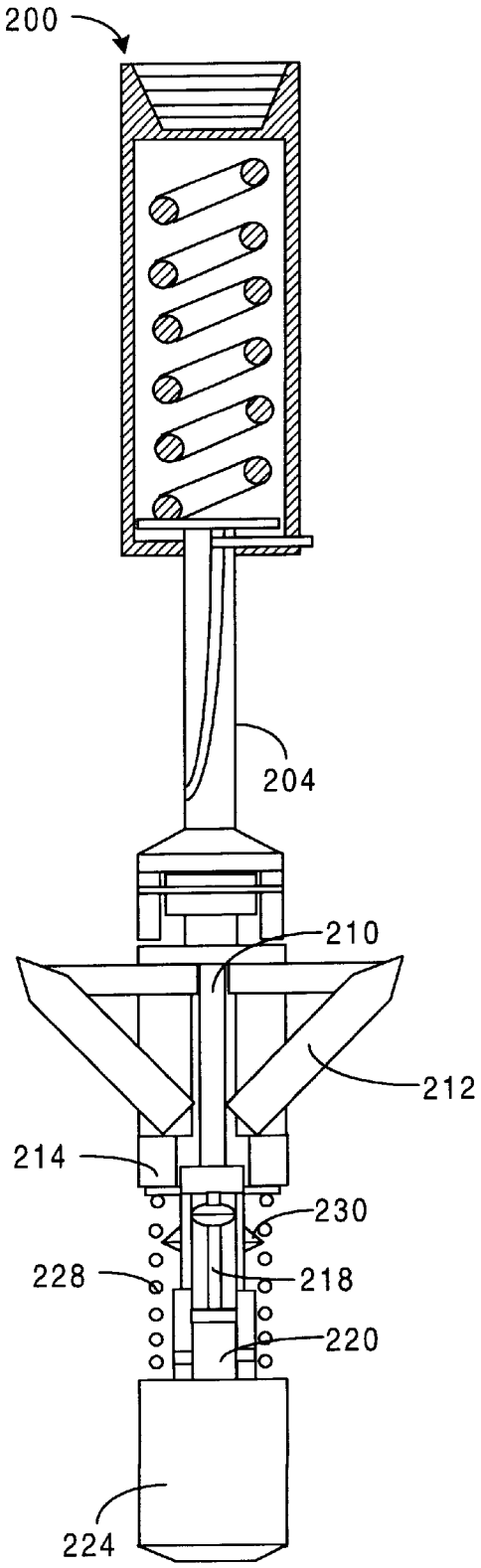
FIG. 2B is a cross-sectional view of the lower anchor shown in FIG. 2A in a deployed position.

Referring to FIGS. 2A and 2B, the oscillating assembly 200 includes an oscillating housing 202 and a mandrel 204. The mandrel 204 is secured to an anchor assembly 206 that is adapted to engage the casing 104 upon landing on the cement section 112 (shown in FIG. 1). The anchor assembly 206 includes a fishing neck 208 that is secured to the lower end of the mandrel 204 by a shear pin 205. A rod 210 extends from the fishing neck 208 through an anchor 212. The anchor 212 is supported on an upper annular body 214. Extending through the annular body 214 is an annular piston 216. The upper end of the annular piston 216 is attached to the rod 210. A mandrel 218 disposed within the annular piston 216 has one end attached to a bull nose 220. The bull nose 220 is secured to the annular piston 216 by a shear pin 222.

The bull nose 220 extends through a lower annular body 224. An annular plate 226 is disposed about the annular piston 216. The annular plate 226 is slidable along the length of the annular piston 216. The annular plate 226 is coupled to the lower annular body 222 by a spring 228. In the compressed state of the spring, collapsible collets 230 on the annular piston 216 restrict upward movement of the annular plate 226. When the tool 100 lands on the cement section 112 with sufficient force to shear the shear pin 222, the bull nose 220 retracts into the lower annular body 222 and pushes the mandrel 218 and rod 210 upwardly. This movement creates a gap between the annular plate 226 and the collets 230, allowing the spring 228 to be released. The force of the spring 228 pushes the annular plate 226 over the collets and against the upper annular body 214 to deploy the anchor 212.

The oscillating housing 202 includes a chamber 232 which houses a resilient member, for example, spring 234. At the lower end of the spring 234 is a plate 236 which is attached to the mandrel 204. The oscillating housing 202 may be moved up and down the mandrel 204 by compressing and extending the spring 234. The axial axis of the mandrel 204 is generally aligned with the axial axis of the well 102 (shown in FIG. 1) so that the oscillating housing 202 moves along the axial axis of the well 102. As the oscillating housing 202 moves, the screen 120 mounted on top of the oscillating housing 202 also moves. This allows for even filling of the annular area between the casing 104 and the screen 120 during gravel packing. A key 238 and slot 240 is provided on the mandrel 204 to allow the oscillating housing 202 and other components above the oscillating housing 202 to turn as the oscillating housing 202 moves relative to the mandrel 204. The shear pin 205 holding the mandrel 204 to the fishing neck 208 is not sheared when the oscillating housing 202 moves relative to the mandrel 204 or when the anchor 212 is deployed. However, the shear pin 205 may be sheared at a later time to permit the tool 100 to be retrieved from the well.

Figure 3A:
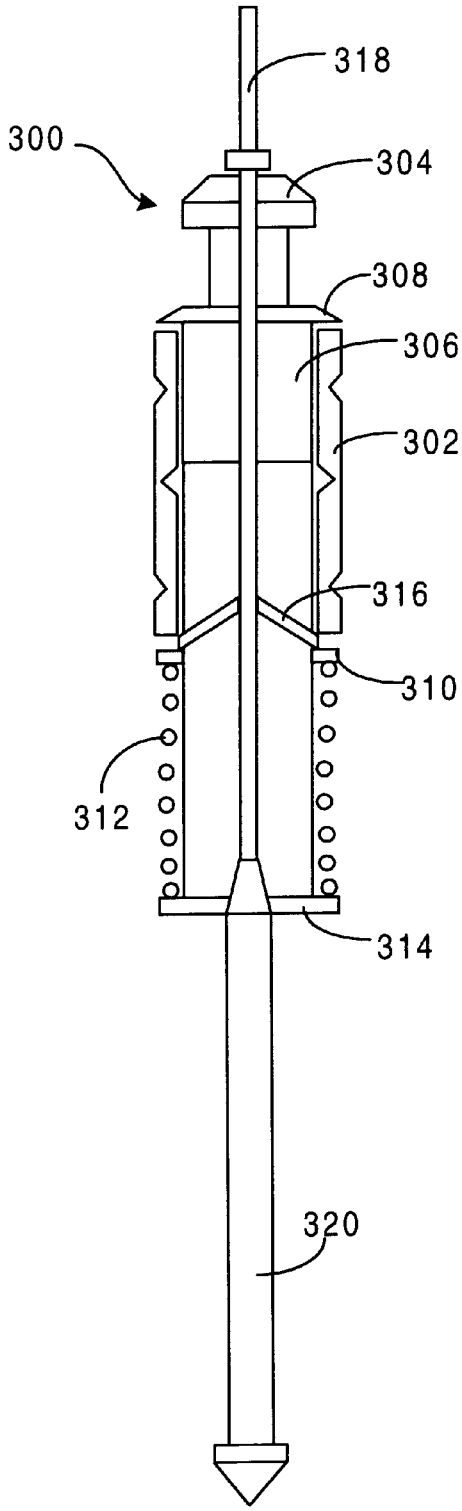
FIG. 3A is a cross-sectional view of the latching head assembly shown in FIG. 1 in a running-in position.
Figure 3B:
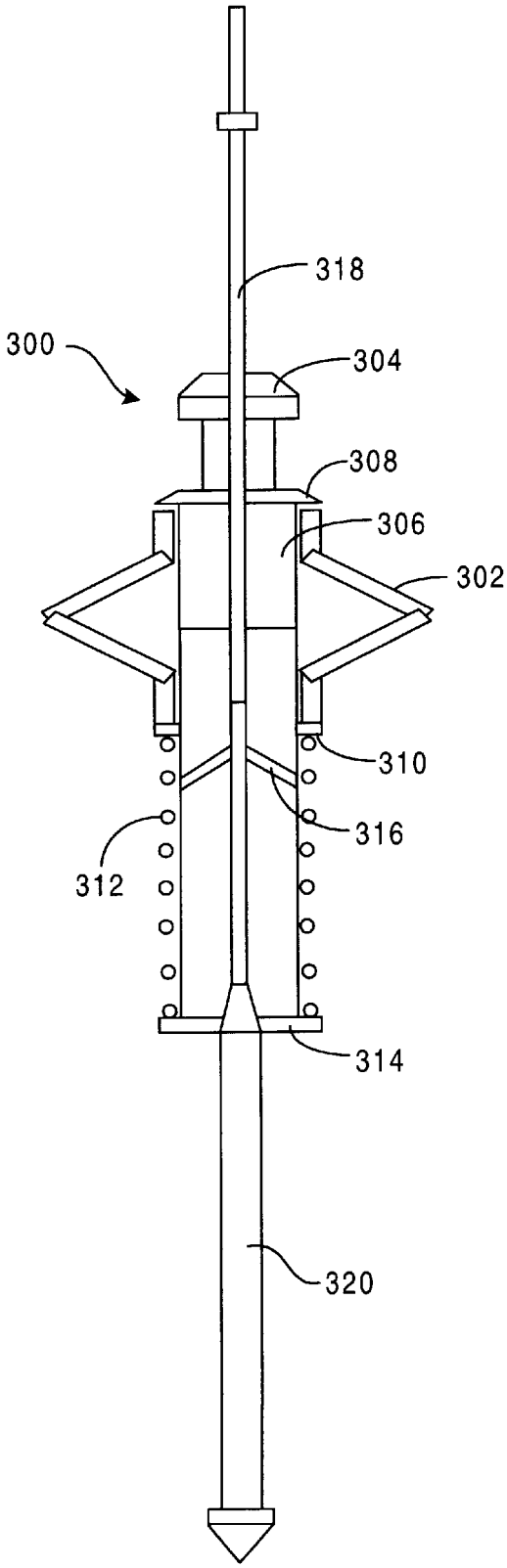
FIG. 3B is a cross-sectional view of the latching head assembly shown in FIG. 3A in a deployed position.

Referring to FIGS. 3A and 3B, the latching head assembly 300 includes a body 306. The latching head 304, previously illustrated in FIG. 1, is attached to the body 306. The upper end of the body 306 includes a threaded collar 308 which allows another threaded tool section to be attached to the body 306. The upper centralizer 302 has one end connected to the threaded collar 308 and a second end connected to a washer 310 that is disposed about the body 306. A spring 312 has one end connected to the washer 310 and another end connected to the lower end 314 of the body 306. The spring 312 is held in a compressed state by locking pins 316. The locking pins 316 are located in grooves in the body 306. Extending through the center of the body 306 is a deployment rod 318. The deployment rod 318 is movable within the body 306 by a releasing tool (not shown).

When the deployment rod 318 is used to run the tool 100 into the well, the locking pins 316 have one end abutting against the washer 310 and another end abutting against the deployment rod 318. The locking pins 316 move inwardly into the body 306 to allow the spring 312 to extend when the deployment rod 318 is released from the body 306. As the spring 312 extends, the upper centralizer 302 extends and centers the tool 100 within the well. The anchor of the upper centralizer 302 is such that when the tool 100 is retrieved, the upper centralizer 302 collapses back to allow the tool to be pulled through restricted diameter area.

Figure 3C:
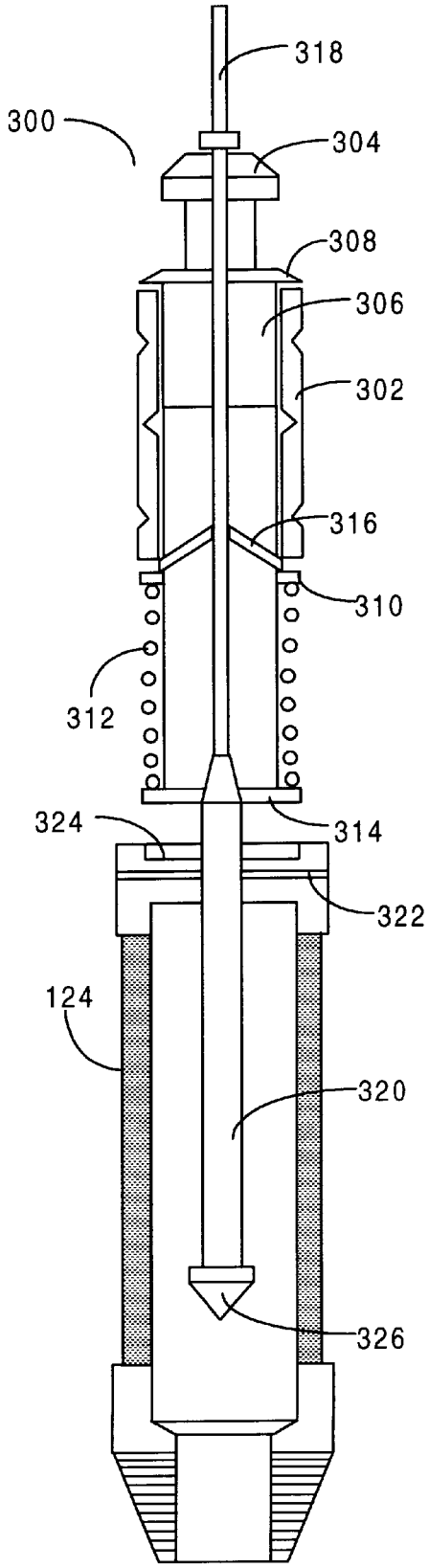
FIG. 3C is a cross-sectional view of the latching head assembly attached to the vent pipe shown in FIG. 1.

Referring to FIG. 3C, the latching head assembly 300 includes a mechanical jar 320 which is fixed to the lower end 314 of the body 306. The mechanical jar 320 extends into the vent pipe 124 and is held in place in the vent pipe 124 by a shear pin 322. The shear pin 322 is sheared when the tool is dropped on the cement section 112. When the shear pin 322 is sheared, the lower end 314 of the body 306 sits on a shoulder 324 at the upper end of the vent pipe 124. The mechanical jar 320 is like a hammer and may be stroked to vibrate the spring 234 in the oscillating housing 202 such that the oscillating housing 202 moves up and down the mandrel 204. As the oscillating housing 202 moves up and down, the screen 120 also moves up and down. The mechanical jar 320 may be stroked by latching onto the latching head 304, raising the latching assembly 300 to a sufficient height, and then subsequently dropping the latching assembly 300. When the latching assembly 300 is dropped, the mechanical jar 320 provides the energy required to vibrate the spring 234. At the end of the mechanical jar 320 is a retaining nut 326 which ensures that the latching head assembly remains coupled to the vent pipe 124.

Figure 4A:
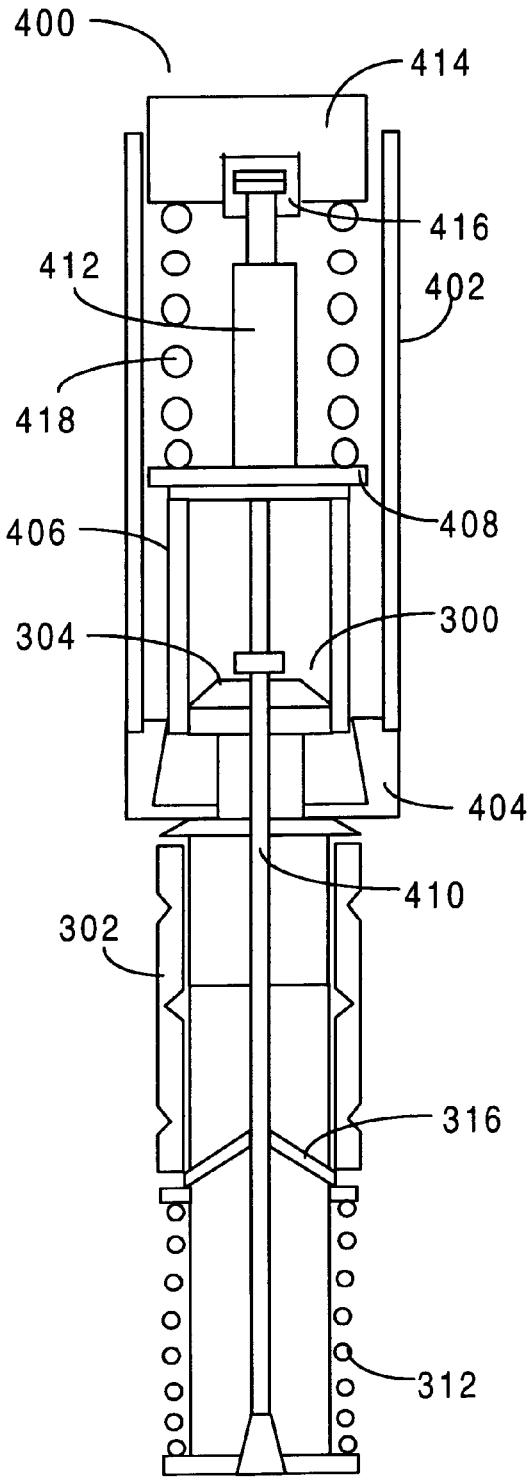
FIG. 4A shows a dump bailer attached to the latching head assembly shown in FIG. 3A.
Figure 4B:
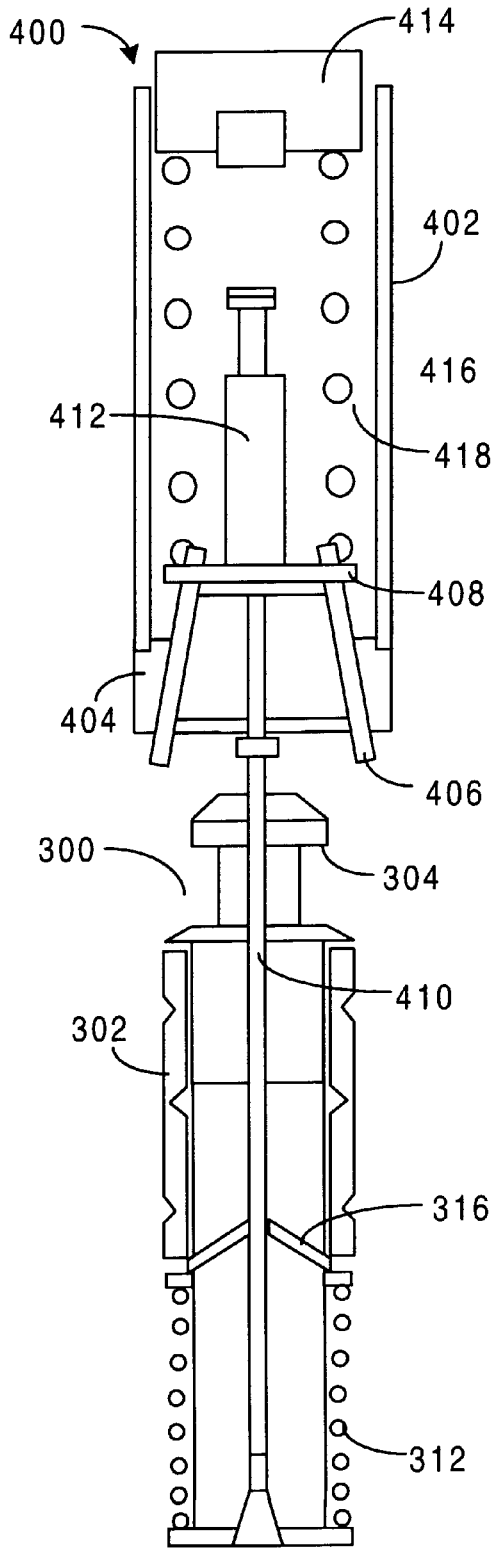
FIG. 4B shows the dump bailer actuator shown in FIG. 4A released from the latching head assembly.

Referring to FIGS. 4A and 4B, a release tool, for example, a dump bailer actuator 400, is shown attached to the latching head assembly 300. The dump bailer actuator 400 includes an extension sleeve 402 which is mounted on a tapered skirt 404 and a grapple 406 that latches onto the latching head 304. At the upper end of the grapple 406 is a plate 408. A deployment rod 410 extends from the plate 408 into the latching head assembly 300. The deployment rod 410 and lock pins 316 prevent the spring 312 from extending to open the upper centralizer 302 before the dump bailer actuator 400 releases the latching head assembly 300. A weight bar extension 412 is mounted on the plate 408. The bar extension 412 is connected to a body 414 by a collet 416. A spring 418 extends between the body 414 and the plate 408. The spring 418 is in a compressed state until the dump bailer actuator 400 is actuated to release the latching head assembly 300.

The dump bailer actuator 400 is operated by moving the extension sleeve 402 and the tapered skirt 404 upwardly such that the grapple 406 slides into the tapered skirt 404. When the grapple 406 slides into the tapered skirt, the spring 418 is extended and the bar extension 412 is separated from the body 414. The grapple 406 releases the latching head 304 when it engages the tapered skirt 404, thus allowing the dump bailer actuator 400 to be separated from the latching head assembly 300. As the dump bailer actuator 400 is pulled from the latching head assembly, the deployment rod 410 is pulled out of the latching head assembly 300 and the locking pins 316 move inwardly to allow the spring 312 to open the centralizer 302.

In operation, when it is desired to gravel pack a new zone, the plug 110 and the cement 112 are set below the new zone. Then a perforating gun is lowered to the new zone to make perforations in the casing 104 and the formation adjacent the casing. When the perforations are made, a release tool, for example, the dump bailer actuator 400, is attached to the tool 100 and the release tool and the tool 100 are lowered to the new zone on the end of a wireline, a slickline or other suitable conveyance device. The release tool is then operated to release the tool 100 such that the tool 100 lands on the cement 112 with sufficient force to release the anchor 212. The released anchor 212 tightly engages the casing 104 and holds the tool 100 in place in the well. The upper centralizer 302 opens when the release tool is detached from the tool 100 and centers the tool 100 within the well. At the same time that the tool 100 is anchored and the upper centralizer 302 is opened, the mechanical jar 320 is sheared from the vent pipe 124. This makes it possible to latch on the latching head assembly 300 and stroke the mechanical jar 320. The latching head assembly 300 can also be used to retrieve the tool 100.

Gravel may be dumped between casing 104 and the screen 120 by a dump bailer. The dump bailer may be a bailer with a frangible bottom that can be opened with an explosive charge. The dump bailer may also be a bailer that can be latched onto the latching head assembly 300 and that has a dump port that can be mechanically opened to dump gravel into the well. The dump bailer is small enough that it can fit through restricted diameters, such as a tubing string, in the well. When the gravel is dumped, the oscillating assembly 200 can be operated to oscillate the screen 120 to ensure that voids in the gravel pack are filled with gravel. More gravel can be dumped into the well until the gravel pack level rises above the upper end of the screen 120. Then the cement cap 116 can be put in place to keep the gravel from loosening.

While the invention has been described with respect to a limited number of embodiments, those skilled in the art will appreciate numerous variations therefrom without departing from the spirit and scope of the invention. For example, the latching head assembly 300 is shown as having one latching head 304, but additional fishing necks can be added to the latching head to allow different types of tools to be latched onto the latching head assembly 300. The latching head and fishing neck may be provided with magnetic markers which will allow a magnetic sensor, for example, a collar locator, to locate them downhole. Additional centralizers may be added to the tool 100 below the flow segment 118 to further centralize the tool 100 within the well.

What is claimed is:

1. An apparatus for use in gravel packing a well having an axial axis, comprising:

a tool body adapted to be lowered into the well;

a screen coupled to the tool body; and a resilient member coupled to the screen to move the screen back and forth substantially along the axial axis in response to an excitation force.

2. The apparatus of claim 1, wherein the resilient member is disposed within a housing coupled to the screen, the housing being arranged to move substantially along the axial axis of the well.

3. The apparatus of claim 2, wherein the housing moves along a mandrel having an axial axis substantially aligned with the axial axis of the well.

4. The apparatus of claim 3, further comprising mutually cooperating structures on the housing and the mandrel which permit the housing to rotate about the axial axis of the well.

5. The apparatus of claim 1, further comprising a mechanism jar coupled to the tool body to provide the excitation force.

6. The apparatus of claim 1, further comprising an anchor member adapted to radially extend to engage the well when the tool body is lowered to a selected position in the well.

7. The apparatus of claim 6, further comprising a position locator for determining the selected position in the well.

8. The apparatus of claim 7, wherein the position locator comprises a tip member coupled to the anchor member, the tip member being arranged to retract and deploy the anchor member upon reaching the selected position in the well.

9. The apparatus of claim 1, further comprising collapsible radially projecting members for centralizing the tool body within the well.

10. The apparatus of claim 1, wherein the tool body is adapted to be lowered into the well on a wireline.

11. The apparatus of claim 1, wherein the resilient member comprises a spring.

12. An apparatus for use in gravel packing a well having an axial axis, comprising:

a tool body adapted to be lowered into the well;

a screen coupled to the tool body;

a mechanical jar coupled to the tool body, the mechanical jar providing an excitation force for vibrating the screen; and an oscillating mechanism adapted to move the screen in an oscillating manner substantially along the axial axis of the well in response to the excitation force.

13. The apparatus of claim 12, wherein the oscillating mechanism comprises a resilient member coupled to the screen, the resilient member oscillating in response to the excitation force.

14. The apparatus of claim 13, wherein the oscillating mechanism further comprises a housing coupled to the screen, the resilient member being disposed within the housing, the housing being arranged to move substantially along the axial axis of the well.

15. The apparatus of claim 14, wherein the housing is adapted to rotate about the axial axis of the well while moving along the axial axis of the well.

16. The apparatus of claim 12, further comprising one or more collapsible radially projecting members for centralizing the tool body within the well.

17. The apparatus of claim 12, wherein the tool body is adapted to be lowered into the well on a wireline.

18. An apparatus for use in gravel packing a well having an axial axis, comprising:

a tool body adapted to be lowered into the well;

a screen coupled to the tool body;

an oscillating mechanism coupled to the screen and adapted to oscillate the screen back and forth substantially along the axial axis of the well in response to an excitation force.

19. The apparatus of claim 18, further comprising an anchor member adapted to radially extend to engage the well when the tool body is lowered to a selected position in the well.

20. The apparatus of claim 19, further comprising a position locator for determining the selected position in the well.

21. The apparatus of claim 20, wherein the position locator comprises a tip member coupled to the anchor member, the tip member being arranged to retract and deploy the anchor member upon reaching the selected position in the well.

22. The apparatus of claim 18, wherein the oscillating mechanism comprises a housing coupled to the screen and a spring disposed within the housing, the spring being arranged to vibrate the housing in response to the excitation force.

23. The apparatus of claim 20, wherein the oscillating mechanism further comprises a mandrel coupled to the spring such that the housing moves along the mandrel as the spring vibrates.

24. The apparatus of claim 23, further comprising mutually cooperating structures on the housing and the mandrel which permit the housing to turn about the mandrel as the spring vibrates.

25. The apparatus of claim 22, further comprising a mechanical jar coupled to the tool body to provide the excitation force.

26. The apparatus of claim 18, wherein the tool body is adapted to be lowered into the well on a wireline.

27. The apparatus of claim 18, further comprising an anchor coupled to the oscillating mechanism and adapted to be set in the well, the screen moveable with respect to the anchor as it is being oscillated.

28. An apparatus for gravel packing a well, comprising:

a tool body adapted to be lowered into the well;

a screen coupled to the tool body;

an oscillating mechanism coupled to the screen for vibrating the screen in response to an excitation force; and a dump bailer adapted to dispose sand control media in an annulus between the screen and the well.

29. A method for gravel packing a well having an axial axis, comprising:

placing a screen at a selected position in the well;

placing a screen at a selected position in the well;

disposing sand control media in an annulus between the screen and the well; and periodically moving the screen substantially along the axial axis of the well to oscillate the screen to allow for even filling of the annulus.

30. The method of claim 29, wherein periodically moving the screen includes using a mechanical jar to exert an excitation force on the screen.

31. The method of claim 29, wherein periodically moving the screen includes vibrating a resilient member coupled to the screen.

32. The method of claim 31, wherein periodically moving the screen includes using a mechanical jar to exert an excitation force on the resilient member.

33. An apparatus for use in a well, comprising:

a screen for positioning in an interval of the well;

an oscillating mechanism adapted to vibrate the screen; and an anchor adapted to be set in the well, the anchor having an activation element responsive to impact with an object in the well to cause the anchor to set.

34. The apparatus of claim 33, further comprising a centralizer adapted to substantially centralize the screen in the well.

35. The apparatus of claim 33, further comprising a mechanical jar to provide an excitation force, wherein the oscillating mechanism is activated by the mechanical jar.

36. The apparatus of claim 35, wherein the oscillating mechanism is adapted to move the screen back and forth substantially along an axial axis of the well.

37. The apparatus of claim 36, wherein the oscillating mechanism comprises a spring adapted to generate movement of the screen.

38. The apparatus of claim 37, wherein the oscillating mechanism further comprises a housing and a mandrel, the housing coupled to the screen, and the spring adapted to move the housing back and forth substantially along the axial axis.

* * * * *